US009789936B2

(12) United States Patent
Vanoise

(10) Patent No.: US 9,789,936 B2
(45) Date of Patent: Oct. 17, 2017

(54) INFLATABLE FENDER

(71) Applicant: Jean-Luc Vanoise, Blessy (FR)

(72) Inventor: Jean-Luc Vanoise, Blessy (FR)

( * ) Notice: Subject to any disclaimer, the term of this patent is extended or adjusted under 35 U.S.C. 154(b) by 105 days.

(21) Appl. No.: 14/782,972

(22) PCT Filed: Apr. 9, 2014

(86) PCT No.: PCT/FR2014/050844

§ 371 (c)(1),
(2) Date: Oct. 7, 2015

(87) PCT Pub. No.: WO2014/167242

PCT Pub. Date: Oct. 16, 2014

(65) Prior Publication Data

US 2016/0304173 A1 Oct. 20, 2016

(30) Foreign Application Priority Data

Apr. 12, 2013 (FR) ..... 13 00868

(51) Int. Cl.
*B63B 59/02* (2006.01)

(52) U.S. Cl.
CPC ..... *B63B 59/02* (2013.01); *B63B 2059/025* (2013.01)

(58) Field of Classification Search
CPC ..... B63B 59/02; B63B 2059/025; E02B 3/26
See application file for complete search history.

(56) References Cited

U.S. PATENT DOCUMENTS 2,179,125 A 11/1939 Kirlin
4,924,796 A * 5/1990 Duffy ..... E02B 3/26 114/219

FOREIGN PATENT DOCUMENTS

| | | | |
|---|---|---|---|
| CN | 201 525 490 | 7/2010 | |
| GB | 1 014 856 | 12/1965 | |
| GB | 2091842 A * | 8/1982 | ..... B63B 59/02 |
| JP | S 55 65614 | 5/1980 | |
| SU | 1 162 679 A1 | 6/1985 | |

OTHER PUBLICATIONS

International Search Report dated Nov. 6, 2014 issued in corresponding International patent application No. PCT/FR2014/050844.

* cited by examiner

*Primary Examiner* — Ajay Vasudeva
(74) *Attorney, Agent, or Firm* — Ostrolenk Faber LLP

(57) ABSTRACT

Inflatable fender having an inflatable first, internal, casing provided at least at one end in the continuation of the chamber with an inflatable tubular appendage (3) equipped with a stoppered end stub (2), this assembly being housed inside an external second casing (5) that hugs the first casing and the appendage (3) and being equipped, at the neck hugging the appendage, with at least one pair of fixings (9) of the D-ring type.

9 Claims, 5 Drawing Sheets

INFLATABLE FENDER

CROSS REFERENCE TO RELATED APPLICATIONS

The present application is a 35 U.S.C. §371 National Phase conversion of PCT/FR2014/050844, filed Apr. 9, 2014, which claims benefit of French Application No. 1300868, filed Apr. 12, 2013, the disclosure of which is incorporated herein by reference. The PCT International Application was published in the French language.

TECHNICAL FIELD OF THE INVENTION

The present invention relates to the suspension links of the textile fender used for protecting hulls of boats.

BACKGROUND OF THE INVENTION

The suspension links of the textile fenders are objects which are stuck, welded or sewn on the flexible upper part of the fender. They create the link between the fender that protects the hull from impacts with the dock where the boat is moored and the end bit passes inside the links, itself secured to the rail of the boat.

The purpose of these links is to suspend the fender by means of an end bit secured to the rail of the boat. They must be capable of supporting intensive vertical traction forces, caused by various movements, in particular the pitching of the boat moored to the dock.

There are three types of fenders:

1. The textile fender provided with flexible suspension links with eyelets, eyelets secured on a tab connected to the fender.

2. The rubber fender provided with suspension links molded in one single piece on production for maximum resistance to vertical traction.

3. The inflatable pvc fender provided with suspension links welded or stuck on vertical reinforcements inside the pvc casing for maximum resistance to vertical traction.

The major drawback caused by using flexible suspension links secured in the upper part of the textile fender is the detachment noticed during the repetitive and violent traction forces caused by the relative movements between the boat hull and the dock to which it is moored.

This drawback alters the quality of the mechanical resistance of the textile casing of the fender, rendering the use of the latter hazardous.

SUMMARY OF THE INVENTION

The device according to the invention allows bringing a remedy to this drawback, an inflated appendage located on the upper part of the body of the inflatable element.

The invention relates to an inflatable fender comprising a first inflatable inner casing (4) provided with at least one end in the continuity of the chamber of an inflatable tubular appendage (3) equipped with a stoppered end stub (2), the assembly being housed in a second outer casing (5) espousing the first casing and the appendage (3) and being equipped, at the neck espousing the appendage, with at least one pair of securing means (9) of the D-ring type.

According to embodiments:

the second outer casing (5) comprises at least a textile material.

the end stub comprises a body with a threaded orifice (13) provided coaxially with a stopper for deflating (12) and a stopper for inflating (11).

the appendage (3) is secured on the neck (5*a*) of the second outer casing (5) on at least two securing areas regularly distributed on the periphery, the first inflatable inner casing (4) not being secured to the second textile outer casing (5).

the appendage (3) is secured by sticking on the neck (5*a*) of the second outer casing (5) on at least two securing areas regularly distributed on the periphery, the first inflatable inner casing (4) not being secured to the second textile outer casing (5).

at least one pair of securing means (9) of the D-ring type are vertically sewn on at least two stitched areas regularly distributed on the periphery on the neck (5*a*) of the second outer casing (5).

said stitched areas cover said securing areas.

the second casing (5) comprises an elastic ring at the open end thereof bearing against the second casing on the outer part of the stub.

the second textile casing (5) comprises a numbering value of at least 800 decitex on the lower right cylindrical part and at least 200 decitex on the remaining part of the neck and near the neck.

Once the appendage inflated, the neck where the suspension links are secured stiffens. The pressure effect of the assembly allows the permanent tensioning of the threads or the mesh of the wall of the neck where the suspension links are secured. The stiffness thus given to the latter allows concentrating the mechanical effects linked to the traction forces on this area (A) FIG. 2.

The neck/body junction of the fender constitutes a barrier which prevents the transmission of the mechanical traction forces detrimental to the body of the fender FIG. 1 (6).

The body of the fender withstands only the area (B) FIG. 2 pressure forces linked to the relative movements of the hull of the boat with respect to the dock at which it is moored, without risk of detachment of the textile mesh.

This makes using the fender safe and efficient for protecting the boat moored to the dock.

BRIEF DESCRIPTION OF THE DRAWINGS

The accompanying drawings illustrate the invention.

DESCRIPTION OF PREFERRED EMBODIMENTS

Figure 1:
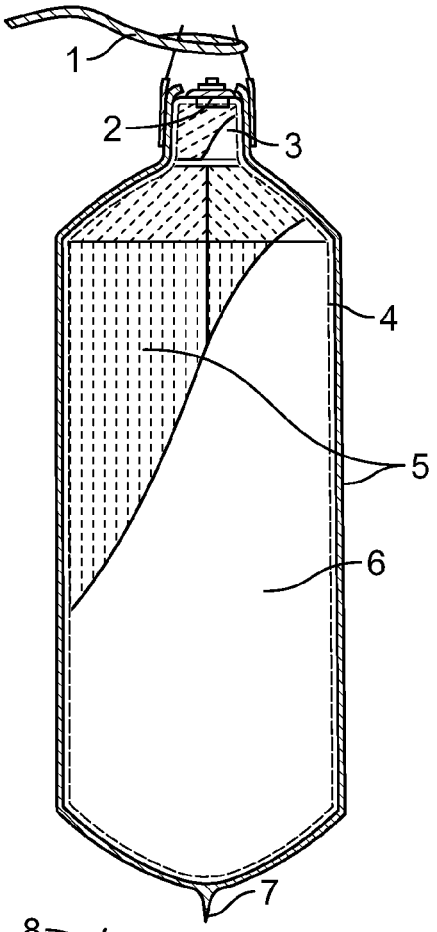
FIG. 1 represents the front view of the assembly of the inflatable element.
Figure 3:
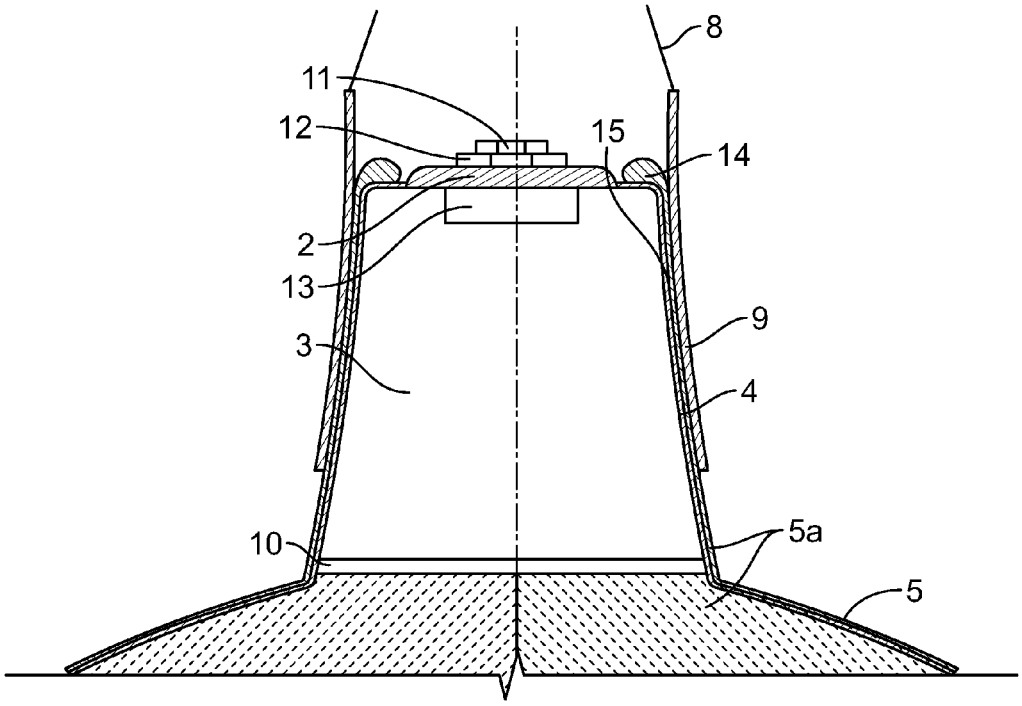
FIG. 3 represents in section, the device of the invention.

With reference to these drawings, FIG. 1 represents the protection of a boat hull of ogival form. The latter not being limiting. This fender is inflatable and deflatable. It comprises an extra flexible inner polyurethane 4 (FIG. 1) partially secured to the wall of the textile neck located at the appendage 5*a* (FIG. 3) of the device of the invention, the preformed knitted or woven outer part 5 (FIG. 1), covers the inflatable inner part 6 (FIG. 1), a stub 2 (FIG. 3) welded on the upper part of the appendage 3 (FIG. 3) equipped with a sealing stopper for inflating 11 (FIG. 3) and deflating 12 (FIG. 3). An end bit 1 (FIG. 1) which allows suspending the fender connected to the boat rail equipped with a flexible ring 7 (FIG. 1) allows the occasional inclination effect of the fender.

Figure 2:
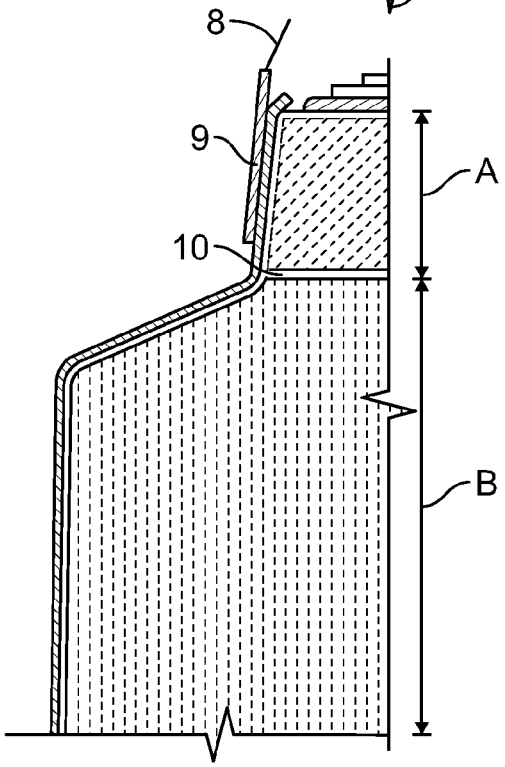
FIG. 2 represents in section, Area (A) the device of the invention, Area (B) the body of the inflatable element.

Once the pressurization of the assembly FIG. 2 areas (A) and (B) is carried out by the user, the fender may be suspended safely to the boat.

Area (A) of FIG. 2 is the area exposed to the vertical tractions of the device of the invention by way of non limiting example. The textile neck 5 (FIG. 5) will have dimensions of the order of 8 cm for the height and a diameter of 5 cm at the belt 10 (FIG. 3). This anti-deformation device integrated on the lower part of the appendage 3 (FIG. 3) allows maintaining its initial form during rises in pressure of the area B (FIG. 2).

The pressure varies between 0.2 bar to 1.8 bar maximum, the suspension links 9 (FIG. 5) sewn on the textile neck are provided with steel D-shaped rings 8 (FIG. 5) allowing the passage of an end bit which itself is connected to the boat rail.

The structure of the different pieces or parts constituting the invention represented by FIG. 3 defines the embodiment of the device of the invention.

The polyurethane material is cut in one single piece folded on itself and welded at the ends in order to create a sealing inflatable casing shaping the body 3 (FIG. 1) and the appendage 3 (FIG. 1).

Then a semi-stiff polyurethane belt 10 (FIG. 3) of a width of 1 cm is secured on the base of the appendage 3 (FIG. 3). This width is not limiting.

On the upper part of the appendage, an orifice is created of a diameter of 3.2 cm to house therein a stub 2 (FIG. 3) equipped with an overlapping lip 16 (FIG. 4) of a width of 1 cm, integrated to a body threaded inside 13 (FIG. 3). The assembly is produced in polyurethane material in one single injection molding operation. It will be welded thanks to the overlapping lip 16 (FIG. 4), on the upper part of the appendage 3 (FIG. 3) of the polyurethane casing 4 (FIG. 3) thereby creating the sealing required for the assembly.

Two stoppers are integrated to the assembly: one stopper with a check valve for the threaded body 13 (FIG. 3) for deflating 12 (FIG. 3), a second stopper provided for inflating 11 (FIG. 3) for the inner part of the stopper 12 (FIG. 3).

The suspension links 9 (FIG. 5) are by way of example textile straps made at the ends of the stainless steel D-shaped rings. The suspension links are thus sewn on the neck of the textile casing 5 (FIG. 5) as well as an elastic 14 (FIG. 5) allowing bending the assembly of the textile neck. The appendage 3 (FIG. 3) will be secured to the inner wall of the textile neck, by the sizing method of the device of the invention.

Figure 4:
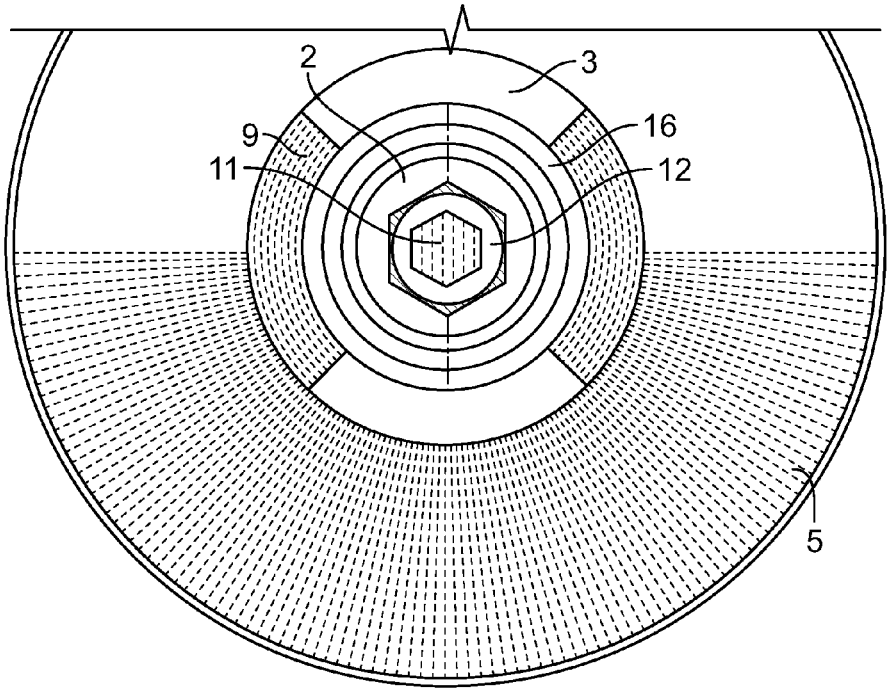
FIG. 4 represents in section, seen from the top, the sealing part of the device of the invention.

FIG. 4 represents the top view of the device of the invention: an inflating stopper 11 (FIG. 4), a second stopper 12 (FIG. 4) equipped with a check valve provided for rapid deflating; a polyurethane stub 2 (FIG. 4), integrated with a polyurethane lip seal provided to be welded; the suspension links 9 (FIG. 4), the polyurethane appendage 3 (FIG. 4), the textile casing 5 (FIG. 4).

Figure 5:
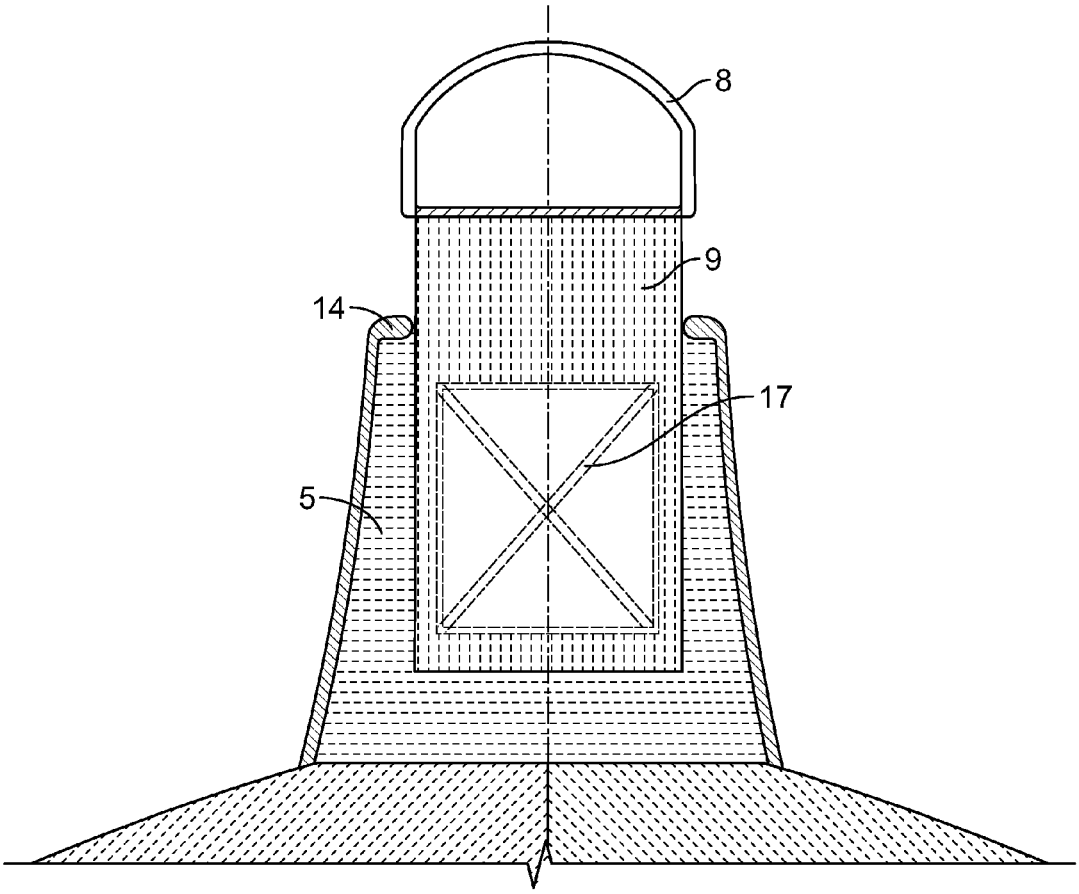
Figure 6:
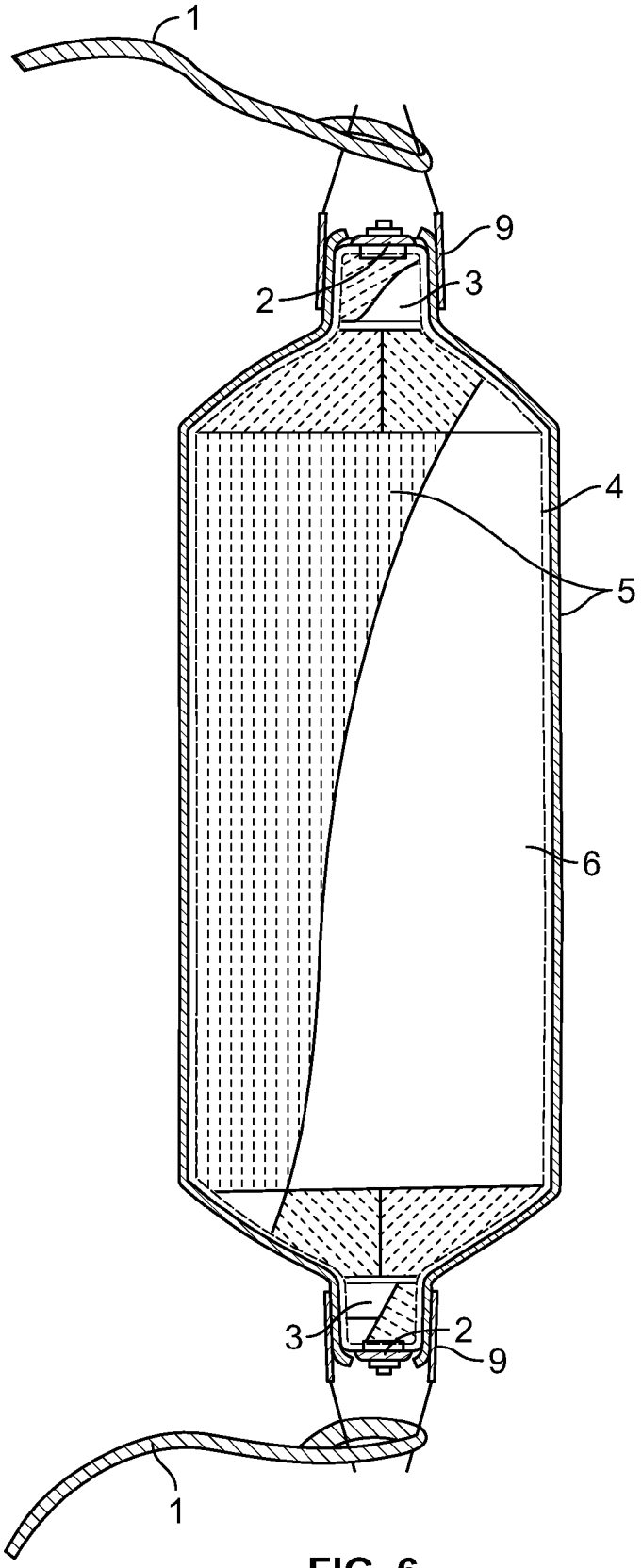
FIG. 6 represents a variant of the invention seen from the front, at two opposite appendages.
Figure 7:
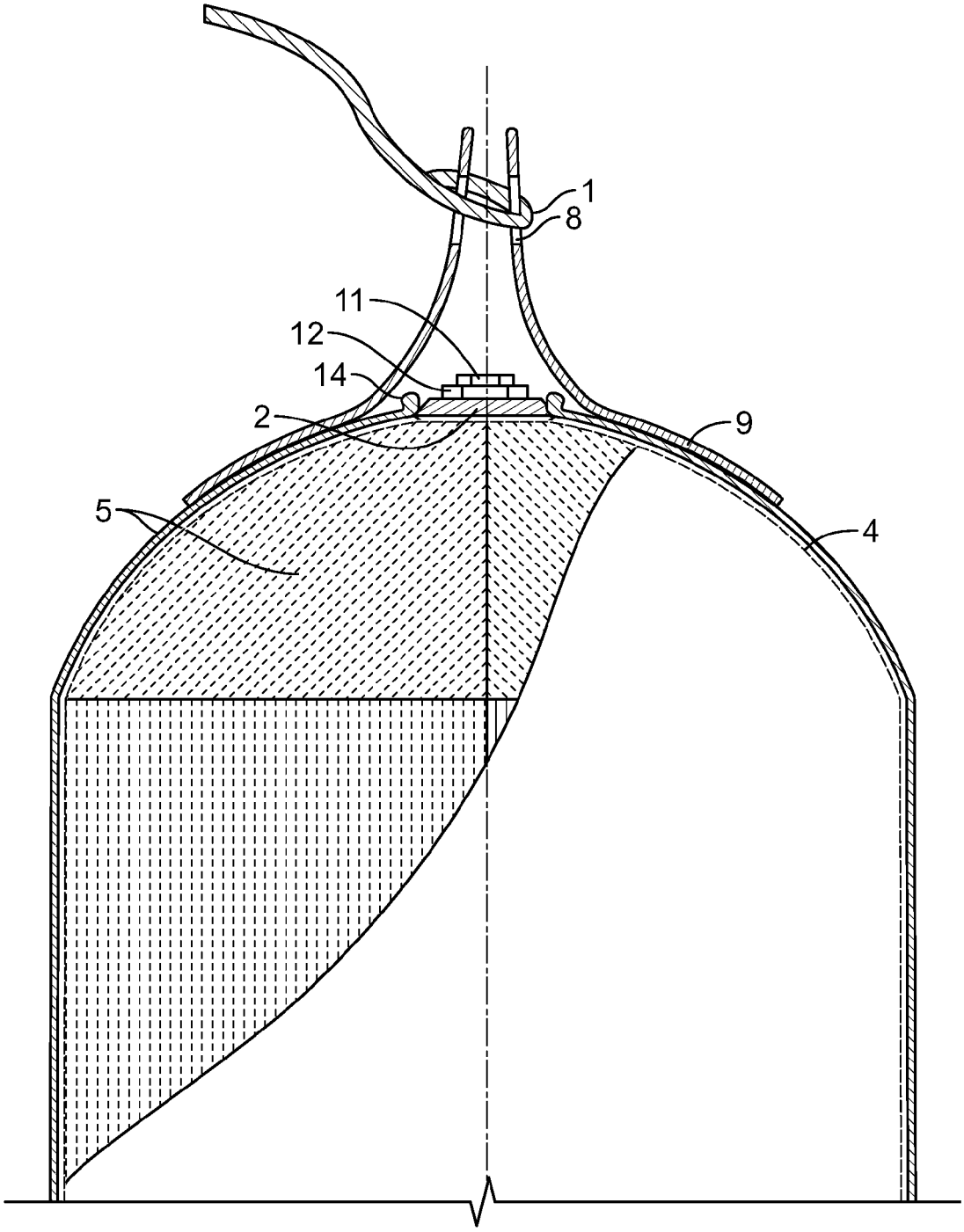
FIG. 7 (Prior Art)
FIG. 7 represents the prior-art of the invention.

FIG. 5 represents the textile body 5 (FIG. 5) and the suspension links 9 (FIG. 5) of type straps woven and lined, with polyester with a very high resistance to traction of a thickness of 2 mm, of a width of 5 cm, and a length of 8 cm. These dimensions are not limiting. The suspension links 9 (FIG. 5) are sewn and produced with a machine by an operator. A twin needle stitching 17 (FIG. 5) produces a rectangle of 6 cm in height, 4 cm in width. A cross in twin needle stitching is carried out inside the rectangle so as to allow a distribution of the mechanical forces linked to the traction exerted by the pitching of the boat at the dock. A stainless steel D-shaped ring 8 (FIG. 5) distributes the load on the link.

The device according to the invention is particularly intended for the safe suspension of the textile fender of a boat moored to the dock.

What is claimed is:

1. An inflatable fender comprising:

a first inflatable inner casing;

an inflatable tubular appendage defining a chamber and equipped with a stoppered end stub;

the first inflatable inner casing having an end continuous with the chamber;

a second outer casing fitting the first inflatable inner casing and the appendage and being equipped with at least one pair of securing D-shaped rings positioned at a neck fitting the appendage.

2. The fender according to claim 1, wherein the second outer casing comprises at least a textile material.

3. The fender according to claim 2, wherein the second outer casing comprises a numbering value of at least 800 decitex on a lower right cylindrical part and at least 200 decitex on a remaining part of the neck and near the neck.

4. The fender according to claim 1, wherein the end stub comprises a body with a threaded orifice provided coaxially with a stopper for deflating and a stopper for inflating.

5. The fender according to claim 1, wherein the appendage is secured on the neck of the second outer casing on at least two securing areas regularly distributed on the periphery, the first inflatable inner casing not being secured to the second outer casing, wherein the second outer casing comprises textile.

6. The fender according to claim 1, wherein the appendage is secured by sticking on the neck of the second outer casing on at least two securing areas regularly distributed on the periphery, the first inflatable inner casing not being secured to the second textile outer casing.

7. The fender according to claim 1, wherein at least one pair of securing D-shaped rings is vertically sewn on at least two stitched areas regularly distributed on the periphery on the neck of the second outer casing.

8. The fender according to claim 7, wherein said stitched areas cover said securing D-shaped rings.

9. The fender according to claim 1, wherein the second outer casing comprises an elastic ring at an open end thereof bearing against the second casing on an outer part of the stub.

* * * * *